US011300292B2

(12) United States Patent
Biermann

(10) Patent No.: US 11,300,292 B2
(45) Date of Patent: Apr. 12, 2022

(54) METHOD OF OPERATING AN INCINERATOR COMPRISING A DEVICE FOR CAPTURING ASH ENTRAINED BY FLUE GAS

(71) Applicant: MINPLUS B.V., Spankeren (NL)

(72) Inventor: Joseph Jan Peter Biermann, Apeldoorn (NL)

(73) Assignee: MINPLUS B.V., Spankeren (NL)

( * ) Notice: Subject to any disclaimer, the term of this patent is extended or adjusted under 35 U.S.C. 154(b) by 0 days.

(21) Appl. No.: 17/258,734

(22) PCT Filed: Sep. 16, 2019

(86) PCT No.: PCT/NL2019/050600
§ 371 (c)(1),
(2) Date: Jan. 7, 2021

(87) PCT Pub. No.: WO2020/055257
PCT Pub. Date: Mar. 19, 2020

(65) Prior Publication Data

US 2021/0164655 A1 Jun. 3, 2021

(30) Foreign Application Priority Data

Sep. 14, 2018 (NL) ..... 2021632

(51) Int. Cl.

| | |
|---|---|
| ***F23G 5/44*** | (2006.01) |
| ***F23G 5/24*** | (2006.01) |
| ***F23J 15/00*** | (2006.01) |
| ***F23J 15/02*** | (2006.01) |

(52) U.S. Cl.
CPC ..... *F23G 5/444* (2013.01); *F23G 5/24* (2013.01); *F23J 15/003* (2013.01); *F23J 15/022* (2013.01); *F23J 2700/001* (2013.01)

(58) Field of Classification Search
CPC ..... F23G 5/444
See application file for complete search history.

(56) References Cited

U.S. PATENT DOCUMENTS

| | | | | | |
|---|---|---|---|---|---|
| 2,718,453 | A * | 9/1955 | Beckman | B01D 53/508 | 423/244.08 |
| 4,640,681 | A * | 2/1987 | Steinbiss | F23G 5/027 | 432/14 |
| 5,334,564 | A * | 8/1994 | Pinnavaia | B01D 53/508 | 252/189 |
| 5,897,688 | A * | 4/1999 | Voogt | B01D 53/64 | 95/133 |
| 6,974,564 | B2 * | 12/2005 | Biermann | B01D 53/02 | 423/210 |

(Continued)

*Primary Examiner* — Nathaniel Herzfeld
(74) *Attorney, Agent, or Firm* — Maschoff Brennan

(57) ABSTRACT

A method facilitates operation of an incinerator for solid fuel. The incinerator includes a device for separating ash from flue gas. The method includes collecting ash deposits originating from the flue gas, resulting in collected ash. To improve the flowability of the ash collected, the method further includes introducing a powdery additive material including i) clay and ii) calcium carbonate into the flue gas. At the location where the additive material is introduced, the flue gas has a temperature of at least 700° C. The additive is introduced with a rate R of at least 0.1 times the mass of ash in the stream of flue gas.

17 Claims, 3 Drawing Sheets

(56) References Cited

U.S. PATENT DOCUMENTS

Figure 1:
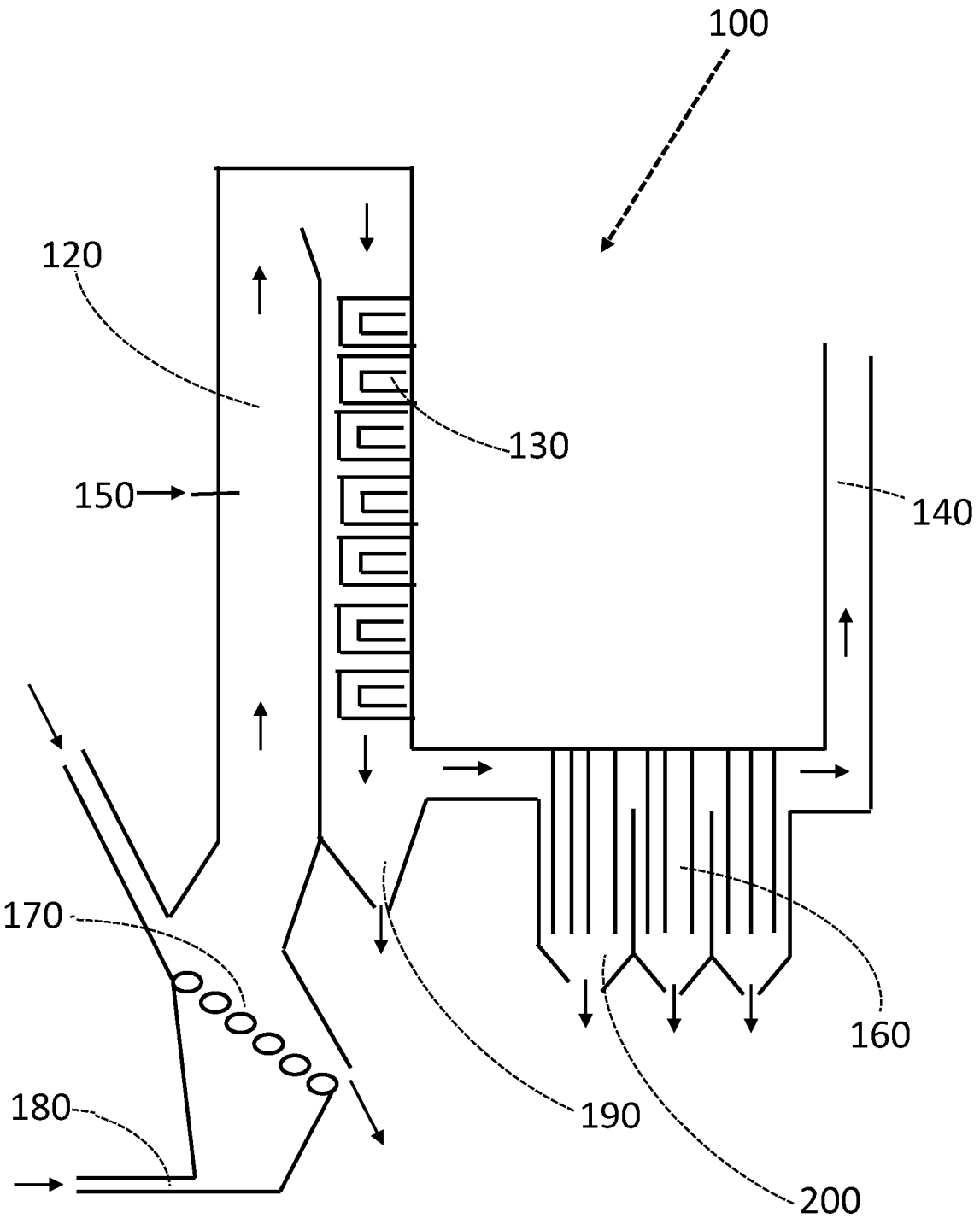

| | | | | |
|---|---|---|---|---|
| 9,925,490 | B2 * | 3/2018 | Kamiyama | B01D 53/501 |
| 2010/0071348 | A1 * | 3/2010 | Kobayashi | F23J 15/006 60/276 |

* cited by examiner

METHOD OF OPERATING AN INCINERATOR COMPRISING A DEVICE FOR CAPTURING ASH ENTRAINED BY FLUE GAS

The present invention relates to a method of operating an incinerator, said incinerator comprising a chamber for incinerating solid fuel in the presence of oxygen-comprising gas, a flue gas channel for passing flue gas emanating from the chamber to an exhaust opening, wherein said flue gas comprises ash, and a device for separating ash from said flue gas into flue gas having a reduced ash content, and ash;

wherein the method comprising the steps of introducing oxygen-comprising gas and a solid fuel into the chamber to incinerate said solid fuel resulting in a stream of flue gas comprising ash, capturing ash from the stream of flue gas comprising ash using the device, and collecting ash deposits originating from the flue gas comprising ash from the incinerator resulting in collected ash.

It is generally known that incineration of a solid fuel results in ash. Part of this ash may remain in the chamber and is collected from there. However, tiny ash particles (fly-ash) may be entrained by the flue gas and would be exhausted into the atmosphere. As this is considered undesirable, it is known to use a device, such as a cyclone, an electrostatic filter, a fabric filter or a gravity settler (a section of the exhaust channel with an increased cross-sectional area and hence a lower flow rate where particles can settle). Such a device has to be to cleaned.

It is a problem that the ash collected from the device, and also the ash collected from the incinerator that was adhered to the inner surfaces of the incinerator after the combustion chamber and before the device, has a tendency of bridge-formation, reducing its tendency to flow. If, for example, the incinerator comprises a valve or auger to remove the collected ash, the ash may not pass the valve or may not enter the auger or may not do so easily and thus isn't easily transported. Also, later on the collected ash has to be transported, e.g. by truck, and the limited ability to flow makes loading the truck take longer.

The object of the present invention is to improve the flowability of ash collected from a stream of flue gas.

To this end, a method according to the preamble is characterized in that the method comprises the step of introducing a powdery additive material comprising i) clay and ii) calcium carbonate using an injection port transverse to the flow of flue gas comprising ash into the flue gas comprising ash wherein the flue gas comprising ash has at the location where the additive material is introduced a temperature of at least 700° C. and is introduced upstream of the device, wherein a powder particle of said powdery additive material comprises granules, each granule comprising a mixture of clay and calcium carbonate, at least 10% by weight relative to the calcium carbonate being calcium carbonate in a form that when characterized by means of Thermogravimetric Analysis under a nitrogen atmosphere with a rate of increase in temperature of 10° C. per minute has decomposed completely when a temperature of 875° C. has been reached; and wherein the powdery additive material is introduced with a rate R of at least 0.1 times the mass of ash in the stream of flue gas comprising ash.

It has been found that the collected material comprising ash and additive is better capable of flowing. It has also been found that the total amount of particles (ash and additive) that is vented to the atmosphere through the exhaust is reduced.

It has been found that not all calcium carbonate is equal. Using Thermogravimetric Analysis (TGA) it is possible to select a calcium carbonate-comprising additive material suitable for the reduction of bridge-forming in the resulting particulate ash material collected from the device.

Thermogravimetric Analysis (TGA) measures the mass reduction upon heating the sample at a specified rate in a specified atmosphere. The measured mass reduction of the additive material then can be attributed to the dissociation of $CaCO_3$ and its simultaneous release of $CO_2$. For the claimed invention, the method described by A. W. Coats and J. P. Redfern, in Thermogravimetric analysis; A review, Analyst, 1963, 88, 906-924, DOI: 10.1039/AN9638800906 is the standard method.

Background: Since the molar weight of $CaCO_3$ and that of CaO differ, this difference in mass due to decomposition under release of $CO_2$ can be measured. In practice, it may be verified that the measured weight loss is actually due to the release of gaseous $CO_2$. To that end, the gas leaving the exit of the TGA measurement device is characterized by means of any suitable method, such as mass spectrometry.

To briefly describe the method of Coats et al, TGA measurements are carried out under a nitrogen atmosphere and at a heating rate of 10° C. per minute from ambient temperature up to typically 1100° C. The weight of the sample is expressed as percent of calcium carbonate, where 100% represents non-converted calcium carbonate. Since the (rounded) molar weight of $CaCO_3$ is 100 g/mol, and that of the $CO_2$ released upon heating the carbonate is 44 g/mol, the remaining mass fraction after decomposition is 56%.

In the art it is known to use dolomite or limestone as additive materials for the capture of $SO_2$. It has been found that these arrive at full decomposition only at higher temperatures and/or increased residence times not amenable to satisfactory practical utility, in particular in case of solid fuel comprising non-fossil biological material (plant material) and household refuse where the temperatures of the flue gas comprising ash are typically relatively low.

In the present application the term solid fuel means that the fuel is solid at a temperature of 30° C. The chamber into which the fuel is introduced is for example a fluidized bed or the chamber of a grate incinerator. The size of the fuel particles may be relatively small (e.g. in the order of millimeters or smaller) or relatively large (e.g. in the order of centimeters or larger). The solid fuel is for example biomass, refuse from industrial processes or households or mixtures thereof.

The term powdery material indicates material having a particle size of less than 100 μm. These particles have a granular nature, i.e. a particle typically comprises a multitude of even smaller particles.

In general, the additive material will be introduced in the flue gas comprising ash where the flue gas comprising ash has a temperature of at least 800° C. and less than 1150° C. In case of an incineration process involving flames, it is preferred that the additive material is injected downstream of the flames. The pneumatic injection typically is carried out using air as transportation medium, using injection ports that are oriented transverse to the direction of the flow of the flue gas, and applying a velocity of the pneumatic transportation medium of typically more than 10 m/s, more preferably more than 15 m/s. It is preferred that the injection is performed using at least one injection lance protruding in the flow of flue gas comprising ash.

The residence time of the additive in the flue gas comprising ash prior to arriving at the device is typically at least 1 second, preferably at least 3 seconds, and more preferably at least 5 seconds. Thus interaction with the ash particles is enhanced for improved capture thereof.

In the present application, the flue gas comprising ash is flue gas containing non-gaseous material. Such non-gaseous material in the flue gas typically comprises solid and/or at least partially molten particles originating from the fuel that turn into solid ash after cooling down. Thus, in the present application the term ash in the term flue gas comprising ash relates to non-gaseous material irrespective of whether it is in a molten or solid form. Typically, the concentration of non-gaseous material is more than 0.02% by wt. relative to the weight of the flue gas.

The method according to the invention is very suitable for the incineration of solid waste material. Thus the solid fuel will typically consist for more than 50%, preferably more than 75%, and even more preferably more than 90% of such material (including mixtures of household and industrial waste materials).

The oxygen-comprising gas is typically air.

Typically the water content of the additive material will be less than 2% wt./wt. of the additive material.

WO2013093097 and US2015/0192295 disclose the use of a clay-based additive to improve properties such as absorption, slagging, and/or agglomeration at high temperatures in the incineration plant. The resulting ash once collected is less flowable than the collected ash obtained using the method according to the present invention. Without wishing to be bound by any particular theory, it is believed that the better flowability of the collected ashes in the present invention is caused by the effective decomposition of the specific calcium carbonate in the additive according to the present invention, which these publications are silent about.

According to a favourable embodiment, at least 40% by weight and more preferably at least 70% relative to the calcium carbonate is calcium carbonate in a form that when characterized by means of Thermogravimetric Analysis under a nitrogen atmosphere with a rate of increase in temperature of 10° C. per minute has decomposed completely when a temperature of 875° C. has been reached.

Thus less additive is needed and a reduced amount of solids has to be captured before release of the flue gas into the atmosphere as may be desired or required.

According to a favourable embodiment, the additive material is introduced using a plurality of injection ports, wherein the number of injection ports is chosen such that the amount of flue gas per injection port is at least 10.000 kg of flue gas per hour.

This has been found to work well and to result in the application of a limited amount of pneumatic transportation air of less than 1% of the applied amount of combustion air into the incinerator due to the limited amount of injection ports, which in turn avoids influencing the delicate balance applied in the incineration process (optimizing combustion, thermal efficiency, and at the same time minimizing $NO_x$ production).

According to a favourable embodiment, the solid fuel is a fuel comprising material of non-fossil biological origin.

The material of non-fossil biological origin is for example biofuel (e.g. miscanthus, wood chips).

According to a favourable embodiment, the additive material is introduced in the flue gas comprising ash where the flue gas comprising ash has a temperature in a range from 875° C. to 1050° C., and preferably in a range from 900° C. to 1000° C.

This has been found to work well. The powdery additive breaks up into smaller granules, which later together with non-gaseous material from the flue gas aggregate into larger particles, effectively catching said non-gaseous material to result in ash with improved capability of flowing.

According to a favourable embodiment, the amount of additive material introduced is controlled in dependence of the ash content in the flue gas comprising ash.

The ash production can be measured by weighing the amount of ash collected from the flue gas and registering the time that has passed between individual collection intervals. Typically, the ash collected from the incinerator is transported for further disposal by means of a vehicle (e.g. a truck) that is weighed at entering (empty) and leaving (loaded with ash) the incineration plant. Vehicle weighing is carried out by means of scales, as familiar to someone skilled in the art. The amount of ash that is not collected from the flue gas is assessed by multiplication of the amount of flue gas ($m^3$/h) and the concentration of the uncollected ash in the flue gas (mg/$m^3$). Measurement methods to assess the amount of flue gas are familiar to someone skilled in the art, as for instance described in procedure NEN-EN-ISO 16911-1. Measurement methods to assess the amount of uncaptured ash in the flue gas (dust measurement) are also familiar to someone skilled in the art, as for instance described in procedure NEN-EN-13284-1:2001.

The term "in dependence" indicates that the amount is positively correlated with the ash content in the flue gas comprising ash.

According to a favourable embodiment, the powdery additive material is introduced with a rate R of 0.2 to 5 times the mass of ash in the stream of flue gas comprising ash, preferably with a rate where R is between 0.3 and 2, and most preferably between 0.4 and 1.2.

This results in collected ash that has even further improved flowability.

According to a favourable embodiment, the incinerator is part of a plant, said plant further comprising a unit for the thermal conversion of paper waste material comprising kaolin, wherein the kaolin is thermally treated in a fluidized bed having a freeboard in the presence of oxygenous gas, wherein the fluidized bed is operated at a temperature between 720 and 850° C. and the temperature of the freeboard is 850° C. or lower to result in the powdery additive material, which is introduced into the flue gas comprising ash of the incinerator.

The method of preparing this powdery additive material is disclosed in detail in WO9606057, which is incorporated by reference.

According to a favourable embodiment, the weight/weight ratio of convertible calcium carbonate to the clay is in the range of 1 to 10, preferably 1 to 5 and more preferably 1 to 3.

Thus the amount of additive material can be kept relatively low while the rate of ash capture is improved.

According to a favourable embodiment, the powdery material has a water content of less than 0.9% wt./wt. %, preferably less than 0.5% wt./wt.

This helps to quickly disperse the powdery material into the flue gas comprising ash.

Figure 2:
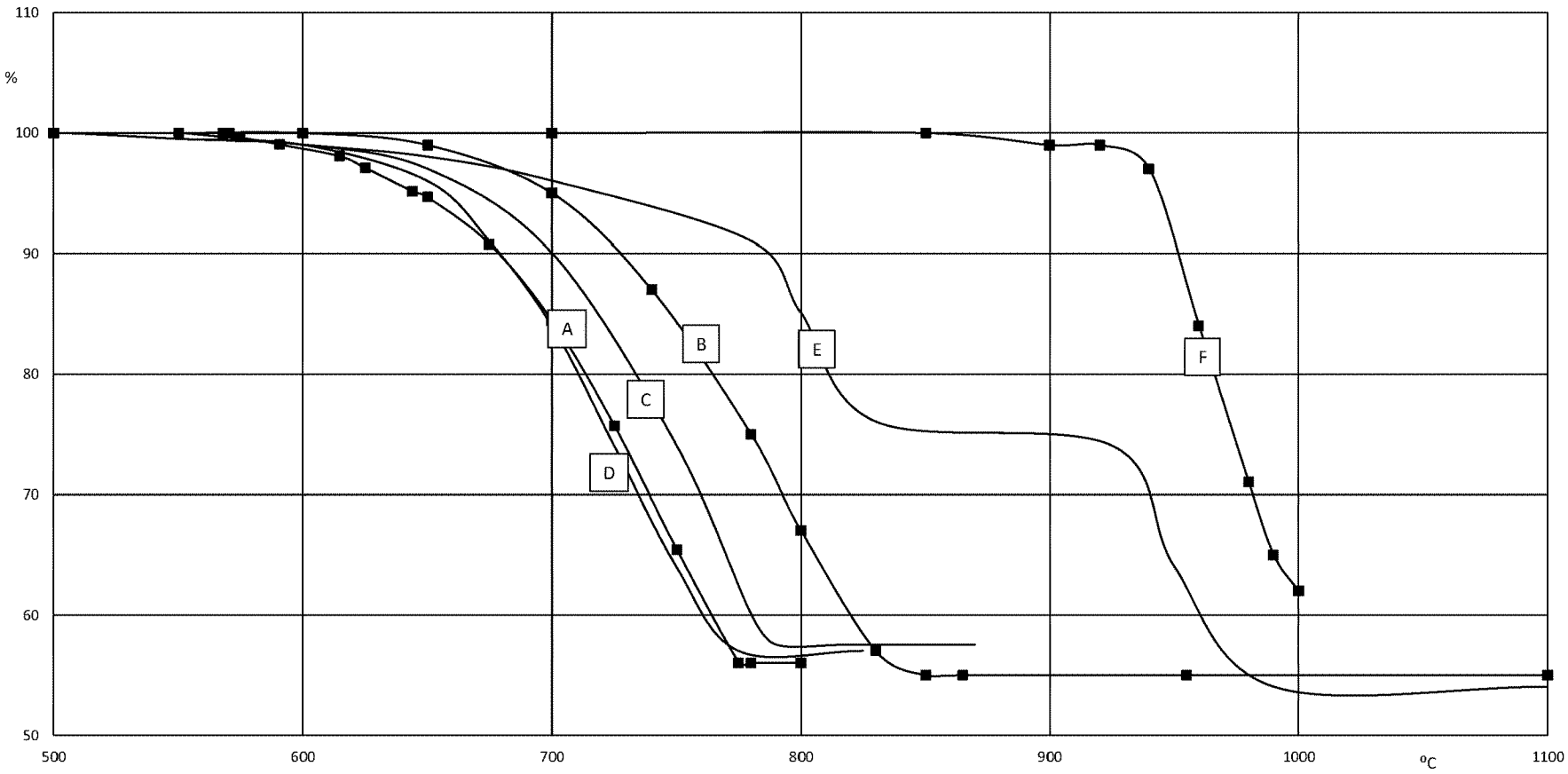
Figure 3:
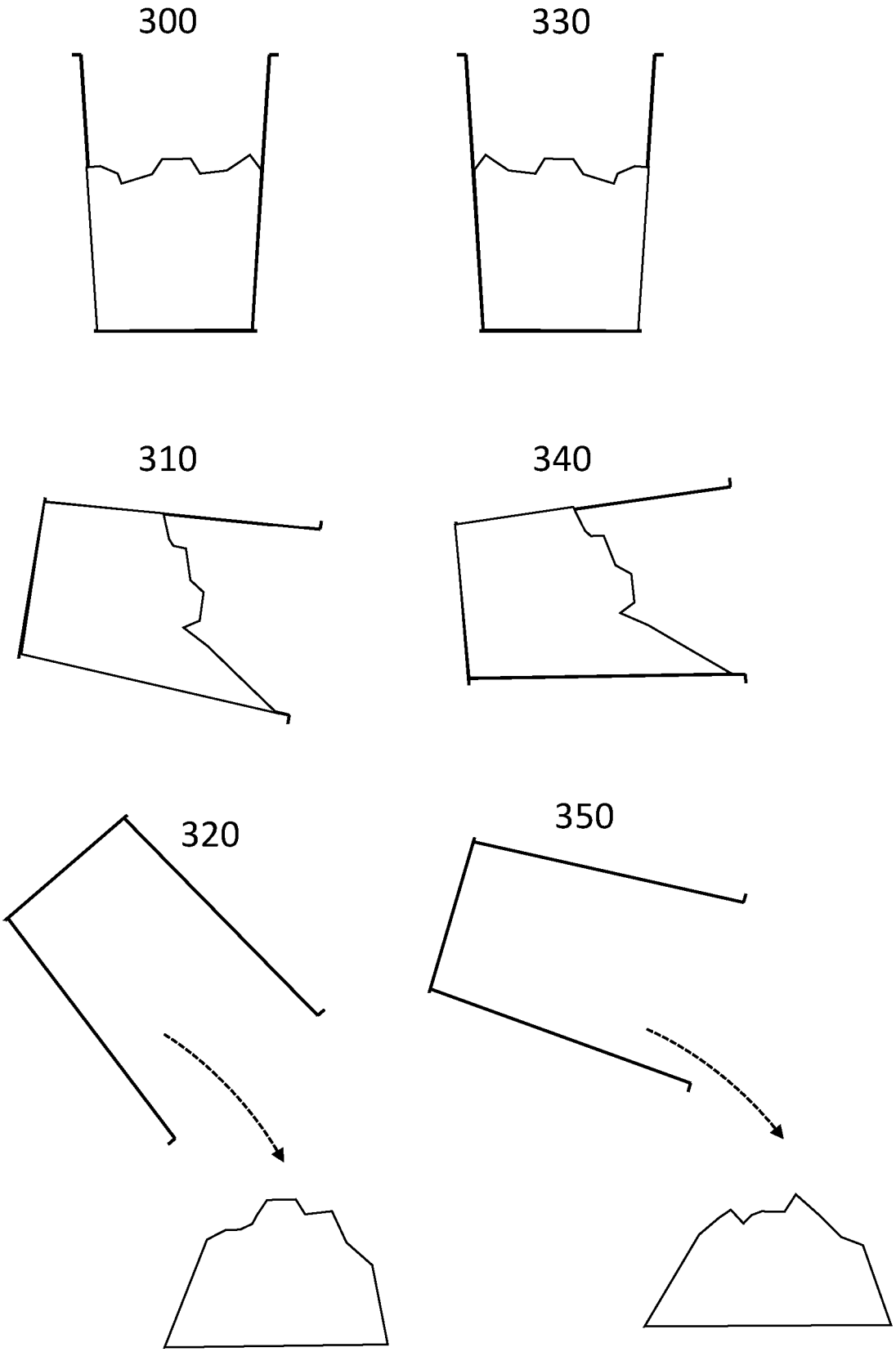

The invention will now be illustrated with reference to the example section below, and with reference to the drawing wherein FIG. 1 shows a schematic view of an incinerator;

FIG. 2 shows a Thermogravimetric Analysis (TGA) graph for various calcium carbonate-comprising materials; and FIG. 3 shows a comparison of the flowability of ash obtained in accordance with the present invention (right) and a control.

FIG. 1 shows a plant comprising an incinerator 100 comprising a combustion chamber 110, a flue gas channel 120, a heat exchanger 130 and an exhaust pipe 140 and a device 160 for separating ash from flue gas, here an electrostatic filter.

A mixture of household and industry derived waste materials is fed from a fuel storage via a hopper on a grate 170. Air is introduced into the combustion chamber 110 via an air supply conduit 180.

Additive material is introduced into the flue gas channel 120 via injection ports 150.

Downstream of a heat exchanger 130, the additive material is separated from the cooled down flue gas comprising ash from the heat exchanger 130 using the device 160 before the cleaned flue gas is vented to the atmosphere via the exhaust pipe 140.

Ash deposited on the heat exchanger 130 is periodically removed and discharged from the incinerator via hopper 190. Ash captured by the device 160 is discharged via hoppers 200.

EXPERIMENTAL SECTION

1. Characterization of Additive Material

The following materials were used for incineration experiments, and characterised as discussed below.

Powder Size

Laser diffraction was used to measure particle size in the range of 0.1-600 μm. Typically, a solid-state, diode laser is focused by an automatic alignment system through the measurement cell. Light is scattered by sample particles to a multi-element detector system including high-angle and backscatter detectors, for a full angular light intensity distribution. In a typical test, 10 mg of a sample was added to the liquid dispersing medium. The recommended dispersing medium for the samples is isopropyl alcohol. 95% by weight of the particles of the samples A to F described below had a size of less than 100 μm.

Additive material suitable for use in the present invention

—A— Calcium carbonate-containing material produced from deinking paper sludge prepared in accordance with WO0009256.

The material's composition was determined by means of X-ray fluorescence. The material contained 30 mass % of calcium carbonate; 25 mass % of calcium oxide; and 36% of silica-alumina clay in the form of meta-kaolin.

Reference Materials:

—B— Laboratory grade calcium carbonate (laboratory grade calcium carbonate, Perkin Elmer Corporation, Waltham, Mass., USA)

—C' Ground limestone (mercury sorbent, sample obtained from the Chemical Lime Company in St. Genevieve, Mo., USA)

—D— Ground limestone (sample obtained from the Mercury Research Center at 19 Gulf Utility, Pensacola, Fla., USA)

—E— Ground dolomite stone (sample obtained from the USA National Institute of Standards and Technology (NIST) denoted as standard reference material (SRM) 88b))

—F— Ground limestone (sample obtained from the USA National Institute of Standards and Technology (NIST) denoted as standard reference material (SRM) 1d. SRM 1d is composed of argillaceous limestone)

Material Decomposition

TGA measurements were carried out in a nitrogen atmosphere and at a heating rate of 10° C. per minute using a Setaram Labsys EVO TGA apparatus (Setaram Company, Caluire, France).

As can be seen in FIG. 2, where the curves A-F correspond to the calcium carbonate-comprising materials listed above, the decomposition of calcium carbonate occurs at different temperatures. For curve E, it is the second steep downward slope at about 950° C. that relates to the decomposition of calcium carbonate, the first steep slope at about 800° C. relating to the decomposition of magnesium carbonate.

EDX Measurements

Individual particles of the additive material (A) produced in accordance with WO0009256 contain both clay and calcium compounds as can be observed from Energy Dispersive X-ray spectroscopy (EDX) applied in conjunction with Electron Microscopy (EM), both methods are considered known to someone skilled in the art. EDX measurements on even the smallest particles visible in the EM, typically having dimensions of a few micrometers, show that in each particle both calcium- and silica/alumina species are present. The calcium represents the calcium and calcium carbonates present in the additive material, whereas the silica/alumina species represent the clay fraction present in the additive material.

2. Incineration Experiment

Experiments were performed using an incinerator 100 as schematically shown in FIG. 1.

The incinerator processed a fuel consisting of household and industrial derived waste materials. The incineration resulted in amounts of ash in the flue gas leaving the combustion chamber 170 that are further detailed in the individual experiments 2A, 2B, and 2C described below. The additive applied was produced from a mixture of paper residue and composted sewage sludge in a weight ratio of 85% to 15%, using the method descried in WO9606057. The additive is injected into the flue gas of the incinerator leaving the incineration chamber at a height of more than 15 meters measured from the lowest point of the incineration grate. During each experiment described below in sections 2A, 2B, and 2C, it was observed that no flames reached this height for more than 90% of the duration of the experiment. The first heat exchanger internal—boiler tube—protruding into the flue gas flow, is located at more than 10 meters downstream of the additive injection location. The temperature of the flue gas at the location of the additive injection varied with the solid fuel and the energy production in the incinerator, being between 800 and 1050° C., as further detailed in the individual experiments 2A, 2B, and 2C. Typically amounts of ash and additive injected into the flue gas by means of pneumatic injection through steel injection ports (right-pointing arrow in FIG. 1) of typically 32 mm internal diameter are further detailed in the individual experiments 2A, 2B, and 2C described below. The averaged velocity of the injection air is also further detailed in the individual experiments 2A, 2B, and 2C described below.

2A. Improved Flowability of Ash (1)

Ash was collected from a waste incinerator plant, that operates several identical incineration furnaces and boilers. One of the furnaces did not apply the additive, and serves as the reference case. The amount of ash collected from the flue gas in the reference case was approximately 400 kg/h. The other furnace applied the additive at a rate of 70 kg/h, which was injected into the flue gas at a temperature of approximately 950° C. by means of four injection ports and a velocity of the injection air of approximately 15 m/s (location indicated with reference number 150 in FIG. 1). The total amount of solids collected from the flue gas was 470 kg/h.

Further operational conditions and material processed in the incinerator were identical within operational variability.

Cups were filled to approximately half full by adding 20 grams of ash (reference case; FIG. 3 left half), and 20 grams of ash obtained with the method using the additive (FIG. 3 right half) with reference number 300 and reference number 330 respectively. The cups were then tilted to observe the moment where the ash or ash+additive mixtures were reaching the point of falling out of the cups. This is indicated by reference numbers 310 and 340 respectively. The material obtained using the method according to the present invention flowed easier—at a lesser tilt of the cup—than the reference material. The required rotation until falling from the cup was approximately 95 degrees for the reference and approximately 80 degrees for the ash plus additive. The cups were then tilted further to observe when the complete amount of ash (reference case) or ash plus additive had fallen out of the cup, as indicated in FIG. 3 by reference numbers 320 (reference ash) and 340 (ash plus additive) respectively. Again, the material flowed easier—at a lesser tilt of the cup—when mixed with the additive. The required rotation to completely empty the cup was approximately 150 degrees for the reference versus approximately 110 degrees for the ash material obtained in accordance with the present invention.

2B. Improved Flowability of Ash (2)

Ash was collected from the flue gas of a waste incineration plant by means of gravimetric sedimentation (FIG. 1 at reference number 190) and electrofiltration (FIG. 1 at reference number 200). Both ash streams were mixed together before loading in silo-containers (trucks). Without further significant variation, two situations were created. The first situation reflects normal operating procedures, without the application of the additive. The second situation reflects the effect of application of the additive. The normal amount of ash collected without the application of the additive was 120 kg/h. The amount of additive that was applied in the second situation was 80 kg/h. The additive was injected by means of five injection ports into the hot flue gas at a flue gas temperature of approximately 900° C. The velocity of the injection air applied in each injection port was approximately 18 m/s. In both situations, the ash that was collected was stored in a silo, from where trucks were filled for further disposal of the ash.

It was observed that in the first situation (no additive applied), all three fill-openings of the truck had to be used to fully load the truck. This implied that the truck had to move under the silo to position each fill-opening underneath the silo-exit chute. The total loading time was in excess of 25 minutes.

It was further observed that in the second situation (with the application of the additive), only the center fill-opening of the truck had to be used to fully load the truck. It was no longer necessary to move the truck under the silo after it had positioned itself for the center fill-opening. The ash-additive mixture displayed positive flow-properties allowing the mixture to freely flow into the truck. The total loading time was reduced to less than 15 minutes.

| | Amount of fill opening applied on truck | Time until truck is full min | Re-positioning of truch # per truckfill |
|---|---|---|---|
| ash - no additive | 3 | >25 | 2 |
| ash plus additive | 1 | <15 | 0 |

2C. Improved Efficiency of Ash Collection

Dosage of 70-100 kg/h of additive to a waste incineration plant into the flue gas at a temperature of 800-1000° C. by means of 4 injection ports at the location indicated in FIG. 1 with the number 150 at a velocity of injection air of approximately 15 m/s, resulted in a significant decrease of solids that passed through the electrostatic precipitator without being removed from the flue gas flow, as indicated in the Table below. The following definitions were applied in the Table below:

| | ash kg/h | Additive kg/h | Total kg/h | Increase | ESP efficiency | Emission from ESP kg/h | Reduced emission from ESP |
|---|---|---|---|---|---|---|---|
| No additve | 100 | 0 | 100 | | 90.00% | 10.00 | |
| Additive | 100 | 80 | 180 | 80% | 98.50% | 2.70 | 73% |

Ash: The amount of ash particles collected from the electrostatic precipitator filtration on an hourly basis. Measurement is carried out by weighing the amount of ash produced and collected over time by measurement of the amount of ash trucked away from the incinerator for further disposal.

Additive: The amount of additive that was injected into the flue gas at a temperature of 800-1000° C. by means of 4 injection ports at the location indicated in FIG. 1 with reference number 150 on an hourly basis. Measurement is carried out by weighed dosage of the additive by means of the discharge of a weighing bin over time.

Total: The sum of the amounts of ash and additive as defined in the previous two sentences. Measurement is carried out by weighing the amount of ash plus additive produced and collected over time by measurement of the amount of ash trucked away from the incinerator for further disposal.

Increase: The mathematical increase in the amount of solids (ash plus additive) added or present in the flue gas prior to removal from the flue gas by means of the electrostatic precipitator filtration.

ESP efficiency: The measured efficiency of the electrostatic precipitator filtration, as defined from the mathematical division of the difference of the amount of solids present in the (raw) flue gas up-stream of the ESP and the amount of solids present in the (cleaned) flue gas down-stream of the ESP, and the amount of solids present in the (raw) flue gas up-stream of the ESP.

Emission from ESP: The amount of uncollected ash or ash+additive material that leaves the electrostatic precipitator filtration with the flue gas through the exhaust as indicated by reference number 140 in FIG. 1. As can be inferred from the measurement results, the amount of material vented to the atmosphere is significantly (73%) reduced upon the application of the additive in accordance with the invention.

The invention claimed is:

1. A method of operating an incinerator (100), said incinerator comprising:

a chamber for incinerating solid fuel in the presence of oxygen-comprising gas, a flue gas channel for passing flue gas emanating from the chamber to an exhaust opening, wherein said flue gas comprises ash, and a device for separating ash from said flue gas into:
flue gas having a reduced ash content, and
ash;

the method comprising:

introducing oxygen-comprising gas and a solid fuel into the chamber to incinerate said solid fuel resulting in a stream of flue gas comprising ash;

capturing ash from the stream of flue gas comprising ash using the device;

collecting ash deposits originating from the flue gas comprising ash from the incinerator resulting in collected ash; and introducing a powdery additive material comprising i) clay and ii) calcium carbonate using an injection port transverse to the flow of flue gas comprising ash into the flue gas comprising ash, wherein:

the flue gas comprising ash has, at the location where the additive material is introduced, a temperature of at least 700° C. and is introduced upstream of the device, a powder particle of said powdery additive material comprises granules, each granule comprising a mixture of clay and calcium carbonate, at least 10% by weight relative to the calcium carbonate being calcium carbonate in a form that when characterized by means of Thermogravimetric Analysis under a nitrogen atmosphere with a rate of increase in temperature of 10' C per minute has decomposed completely when a temperature of 875° C. has been reached; and the powdery additive material is introduced with a rate R of at least 0.1 times the mass of ash in the stream of flue gas comprising ash.

2. The method according to claim 1, wherein at least 40% by weight relative to the calcium carbonate is calcium carbonate in a form that when characterized by means of Thermogravimetric Analysis under a nitrogen atmosphere with a rate of increase in temperature of 10° C. per minute has decomposed completely when a temperature of 875° C. has been reached.

3. The method according to claim 1, wherein:

the additive material is introduced using a plurality of injection ports, and the number of injection ports is chosen such that the amount of flue gas per injection port is at least 10.000 kg of flue gas per hour.

4. The method according to claim 1, wherein the solid fuel is a fuel comprising material of non-fossil biological origin.

5. The method according to claim 1, wherein the additive material is introduced in the flue gas comprising ash where the flue gas comprising ash has a temperature in a range from 875° C. to 1050° C.

6. The method according to claim 1, wherein the amount of additive material introduced is controlled in dependence of the ash content in the flue gas comprising ash.

7. The method according to claim 1, wherein the powdery additive material is introduced with a rate R of 0.2 to 5 times the mass of ash in the stream of flue gas comprising ash.

8. The method according to claim 1, wherein:

the incinerator is part of a plant, said plant further comprising a unit for the thermal conversion of paper waste material comprising kaolin, wherein the kaolin is thermally treated in a fluidized bed having a freeboard in the presence of oxygenous gas, and the fluidized bed is operated at a temperature between 720 and 850° C. and the temperature of the freeboard is 850° C. or lower to result in the powdery additive material, which is introduced into the flue gas comprising ash of the incinerator.

9. The method according to claim 1, wherein the weight/weight ratio of convertible calcium carbonate to the clay is in the range of 1 to 10.

10. The method according to claim 1, wherein the powdery material has a water content of less than 0.9% wt./wt.

11. The method according to claim 2, wherein at least 70% by weight relative to the calcium carbonate is calcium carbonate in a form that when characterized by means of Thermogravimetric Analysis under a nitrogen atmosphere with a rate of increase in temperature of 10° C. per minute has decomposed completely when a temperature of 875° C. has been reached.

12. The method according to claim 5, wherein the additive material is introduced in the flue gas comprising ash where the flue gas comprising ash has a temperature in a range from 900° C. to 1000° C.

13. The method according to claim 7, wherein R is between 0.3 and 2.

14. The method according to claim 7, wherein R is between 0.4 and 1.2.

15. The method according to claim 9, wherein the weight/weight ratio of convertible calcium carbonate to the clay is in the range of 1 to 5.

16. The method according to claim 9, wherein the weight/weight ratio of convertible calcium carbonate to the clay is in the range of 1 to 3.

17. The method according to claim 10, wherein the powdery material has a water content of less than 0.5% wt./wt.

* * * * *